US009256181B2

(12) United States Patent
Teramoto

(10) Patent No.: US 9,256,181 B2
(45) Date of Patent: Feb. 9, 2016

(54) BELT UNIT AND IMAGE FORMING APPARATUS

(71) Applicant: Sharp Kabushiki Kaisha, Osaka (JP)

(72) Inventor: Yudai Teramoto, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 14/170,871

(22) Filed: Feb. 3, 2014

(65) Prior Publication Data

US 2014/0219675 A1 Aug. 7, 2014

(30) Foreign Application Priority Data

Feb. 5, 2013 (JP) ..... 2013-020042

(51) Int. Cl.
*G03G 15/00* (2006.01)

(52) U.S. Cl.
CPC .... *G03G 15/5054* (2013.01); *G03G 2215/0132* (2013.01); *G03G 2215/0164* (2013.01)

(58) Field of Classification Search
CPC ..... G03G 15/5054; G03G 15/0131
USPC ..... 399/74, 302, 308
See application file for complete search history.

(56) References Cited

U.S. PATENT DOCUMENTS 6,301,023 B1 10/2001 Hirai et al.

FOREIGN PATENT DOCUMENTS

| | | | | |
|---|---|---|---|---|
| JP | 11-220586 | A | | 8/1999 |
| JP | 2002-308520 | A | | 10/2002 |
| JP | 2006023470 | A | * | 1/2006 |
| JP | 2007272154 | A | * | 10/2007 |
| JP | 2008-241958 | A | | 10/2008 |
| JP | 2009-109830 | A | | 5/2009 |
| JP | 2009-169273 | A | | 7/2009 |
| JP | 2011-257646 | A | | 12/2011 |

* cited by examiner

*Primary Examiner* — Erika J Villaluna
(74) *Attorney, Agent, or Firm* — Renner, Otto, Boisselle & Sklar, LLP

(57) ABSTRACT

An image forming apparatus 100 includes an intermediate transfer belt 21, a reading section 25, and an intermediate transfer unit 2 having a supplementary roller 26. The intermediate transfer belt 21 is passed over a drive roller 22 and an idle roller 23, and moves along a predetermined circulating path. The reading section 25 reads a concentration of a toner image from a surface of the intermediate transfer belt 21. The supplementary roller 26 is in contact with a rear face of the intermediate transfer belt 21 in such a manner that a gap between a reading face of the reading section 25 and the surface of the intermediate transfer belt 21 is kept constant. The supplementary roller 26 is disposed on a downstream side of the reading section 25 in a horizontal direction by a predetermined distance S. The predetermined distance S is a distance from a center M of the reading section 25 to a point of contact P at which the supplementary roller 26 is in contact with the intermediate transfer belt 21 in a horizontal direction.

3 Claims, 6 Drawing Sheets

Fig.3

| PATTERN | PREDETERMINED DISTANCE S | TONER ADHESION STATE | READABILITY | READING RESULT |
|---|---|---|---|---|
| 1 | PREDETERMINED DISTANCE S=0 | × | ◎ | × |
| 2 | 0 < PREDETERMINED DISTANCE S < SUPPLEMENTARY ROLLER RADIUS R | △ | ○ | △ |
| 3 | PREDETERMINED DISTANCE S = SUPPLEMENTARY ROLLER RADIUS R | ◎ | ○ | ○ |
| 4 | PREDETERMINED DISTANCE S > SUPPLEMENTARY ROLLER RADIUS R | ◎ | △ | △ |

BELT UNIT AND IMAGE FORMING APPARATUS

CROSS REFERENCE

This Nonprovisional application claims priority under 35 U.S.C. §119(a) on Patent Application No. 2013-020042 filed in Japan on Feb. 5, 2013 the entire contents of which are hereby incorporated by reference.

BACKGROUND OF THE INVENTION

The present invention relates to a belt unit provided with a reading section that reads a toner image borne on a surface of an endless belt and to an image forming apparatus.

Among image forming apparatus according to the electrophotography method is one that is provided with a belt unit transferring a toner image using the endless belt to an object to which the transferring is made.

Due to environmental variations such as temperature, humidity and/or the like and deterioration with passage of time such as degradation of an image bearing member and/or degradation of the toner, it is made impossible for the belt unit to maintain a pertinent concentration of the toner image that is borne on the endless belt, which occasionally results in image quality failure. In this regard, as disclosed in the Japanese Patent Unexamined Publication No. 2008-241958 bulletin, among the image forming apparatus each provided with a belt unit is one in which concentration of the toner image is adjusted by forming a reference toner image onto the endless belt with a predetermined imaging condition, then reading the concentration of the reference toner image from the surface of the endless belt by the reading section, and then changing the imaging condition so that the concentration that is read becomes a predetermined reference concentration. In order for the reading section to read the concentration of the reference toner image accurately, it is necessary to prevent flapping of the endless belt while keeping a gap between the reading section and the surface of the endless belt constant; therefore, when the reading is carried out by the reading section, a supplementary roller is caused to be in contact with a rear face of the endless belt.

Further, the reading section sometimes includes means for detecting meandering quantity of the endless belt for use in meandering adjustment of the endless belt.

Yet, because the endless belt is curved at a portion that is in contact with the supplementary roller, toner's falling from the curved surface can occasionally occur. If the falling toner sticks to a reading face, it follows that the reading section becomes unable to read the toner image from the surface of the endless belt accurately.

The present invention is directed to providing a belt unit that can prevent the toner falling from the endless belt from sticking to the reading face of the reading section, and an image forming apparatus.

SUMMARY OF THE INVENTION

A belt unit of the present invention includes an endless belt, a reading section and a supplementary roller. The endless belt is supported in such a manner that a surface thereof bearing a toner image can perform a circulating motion along a predetermined moving direction. The reading section is disposed below the endless belt in vertical direction, and reads the toner image from the surface of the endless belt. The supplementary roller is in contact with a rear face of the endless belt in such a manner that a gap between a reading face of the reading section and the surface of the endless belt is kept constant, and is located on a downstream side of the reading section in a horizontal direction by a predetermined distance. The predetermined distance is a distance from a center of the reading face to a point of contact at which the supplementary roller is in contact with the endless belt in the horizontal direction.

BRIEF DESCRIPTION OF THE DRAWINGS

FIG. 3 shows results of measurements made on toner adhesion state, readability and reading result.

DETAILED DESCRIPTION OF THE INVENTION

Figure 1:
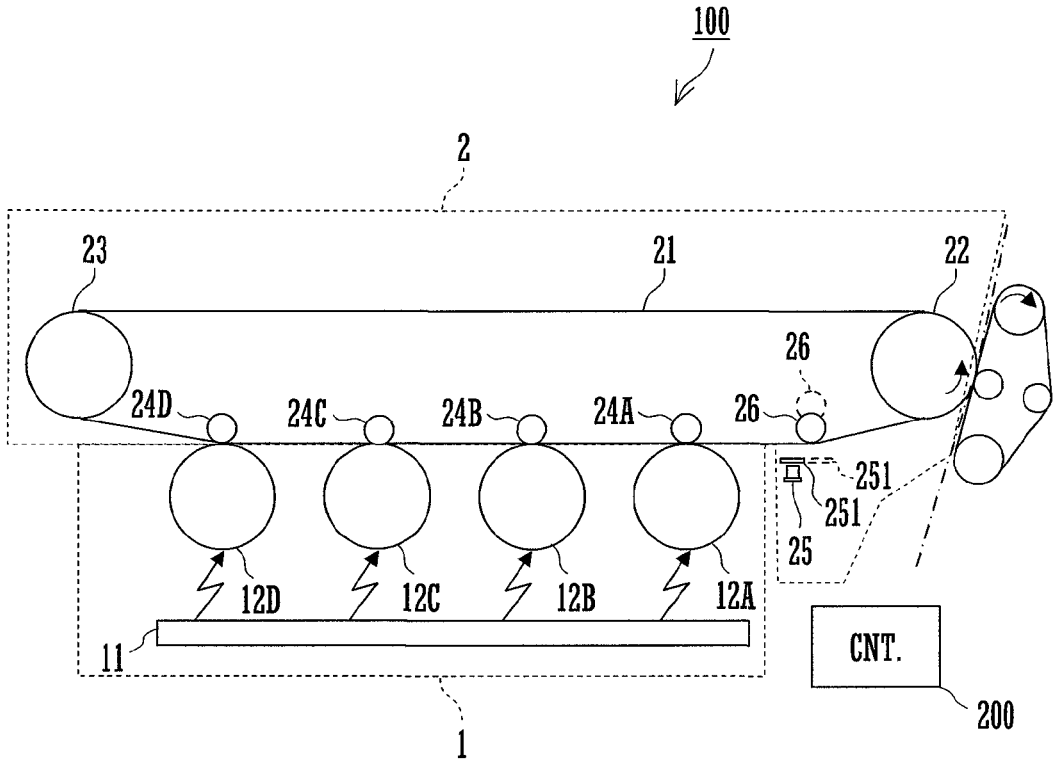
FIG. 1 is a schematic drawing of a part of an image forming apparatus according to an embodiment of the present invention.

Below, an image forming apparatus that is provided with an intermediate transfer unit which is a belt unit of the present invention is explained, referring to the drawings. As shown in FIG. 1, the image forming apparatus 100 includes, as an example, a processing section 1, an intermediate transfer unit 2 and a control section 200, and performs an image forming process onto a paper sheet according to the electrophotography method using image data inputted from an external device which is not illustrated, based on directions by the control section 200.

The processing section 1 includes an exposure unit 11 and photoreceptor drums 12A through 12D. After forming electrostatic latent images on surfaces of the photoreceptor drums 12A through 12D by projecting image lights that depend on the image data from the exposure unit 11, the processing section 1 renders the electrostatic latent images visible in toner images by supplying toners.

The intermediate transfer unit 2 includes an intermediate transfer belt (corresponding to an endless belt of the present invention) 21, a drive roller 22, an idle roller 23, primary transfer rollers 24A through 24D, a reading section 25 and a supplementary roller 26. The intermediate transfer belt 21 is passed over the drive roller 22 and the idle roller 23, and moves along a circulating path that passes through the photoreceptor drums 12D, 12C, 12B, 12A in this order.

The primary transfer rollers 24A through 24D are disposed at positions opposite the photoreceptor drums 12A through 12D across the intermediate transfer belt 21. The primary transfer rollers 24A through 24D are configured so as to be movable between contacting positions at which a surface of the intermediate transfer belt 21 is caused to be in contact with the photoreceptor drums 12A through 12D and separate positions at which the surface of the intermediate transfer belt 21 is caused to be away from the photoreceptor drums 12A through 12D. When primary transfer voltages are applied, the primary transfer rollers 24A through 24D perform primary transfers of the toner images from surfaces of the photoreceptor drums 12A through 12D onto the surface of the intermediate transfer belt 21.

The reading section 25 is an optical sensor that includes a light emitting element such as LED and a light receiving element such as photodiode, and reads concentrations of the toner images on the surface of the intermediate transfer belt 21. The reading section 25 is disposed in such a manner that a reading face thereof faces the surface of the intermediate transfer belt 21. The reading section 25 projects a light from the light emitting element toward the surface of the intermediate transfer belt 21, and receives a reflected light that is reflected at the surface of the intermediate transfer belt 21 with the light receiving element. The reading section 25 reads the concentrations of the toner images depending on light quantities that the light receiving element has received, based on differences in the light quantities between a reflected light from the surface of the intermediate transfer belt 21 and reflected lights from the toners.

Figure 2:
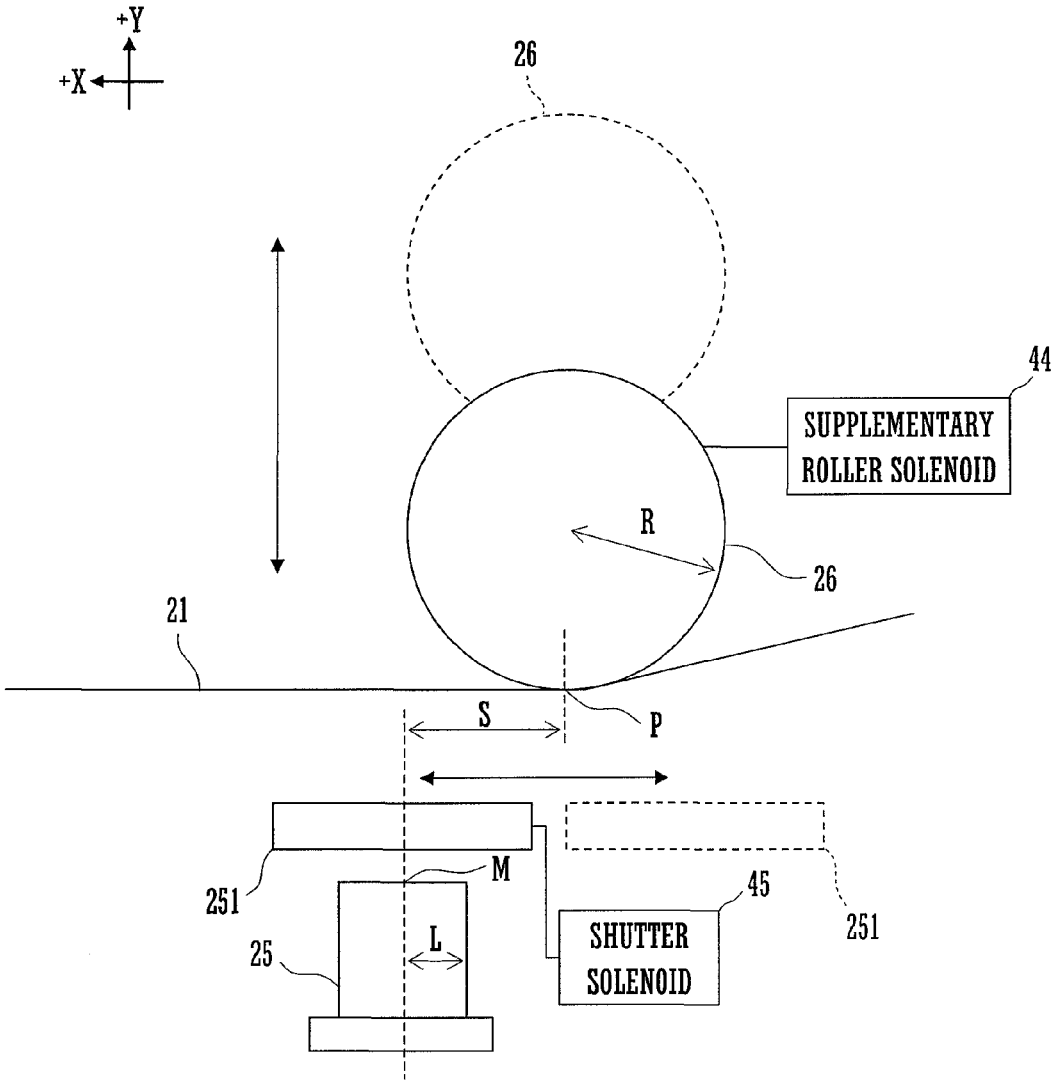
FIG. 2 is an enlarged view of a reading section of the image forming apparatus and a neighborhood of a supplementary roller.

As shown in FIG. 2, a shutter 251 is provided between the reading face of the reading section 25 and the surface of the intermediate transfer belt 21. The shutter 251 is configured so as to be movable between a closed position at which the shutter 251 closes the reading face of the reading section 25 and an open position at which the shutter 251 opens the reading face of the reading section 25. The shutter 251, to which a shutter solenoid 45 is connected, moves to the open position when electricity is turned on to the shutter solenoid 45, and moves to the closed position when electricity is not turned on to the shutter solenoid 45.

The supplementary roller 26 is configured so as to be movable between a contacting position at which the supplementary roller 26 is in contact with a rear face of the intermediate transfer belt 21 in such a manner that a gap between the reading face of the reading section 25 and the surface of the intermediate transfer belt 21 is kept constant, and a separate position at which the supplementary roller 26 is away from the rear face of the intermediate transfer belt 21. The supplementary roller 26, to which a supplementary roller solenoid 44 is connected, moves to the contacting position when electricity is turned on to the supplementary roller solenoid 44, and moves to the separate position when electricity is not turned on to the supplementary roller solenoid 44.

The supplementary roller 26 is disposed on a downstream side of the reading section 25 in a horizontal direction by a predetermined distance S. The predetermined distance S is a distance from a center M of the reading section 25 to a point of contact P at which the supplementary roller 26 comes into contact with the intermediate transfer belt 21 in the horizontal direction.

FIG. 3 shows results of measurements made on toner adhesion state, readability and reading result for each predetermined distance S in a case where a radius R of the supplementary roller 26 is 5 mm and a distance L from the center M to one edge of the reading section 25 is 2 mm.

The toner adhesion state shows an extent of the toner having fallen from the intermediate transfer belt 21 and having stuck to the reading face of the reading section 25. ◎, ○, Δ and X respectively indicate that there was no adhesion, almost no adhesion, a little adhesion, and a large amount of adhesion.

The readability shows an extent to which the toner images were readable from the surface of the intermediate transfer belt 21 using the reading section 25 of which reading face the toner does not stick to. ◎, ○, Δ and X respectively indicate that the toner images were excellently readable, readable, partly readable and unreadable.

The reading result shows an extent as to how accurate the reading result by the reading section 25 was after the reading section 25 had been used for a predetermined period of time. ○, Δ and X respectively show that accurate reading was possible, that wrong reading occurred, and that accurate reading was impossible.

When the predetermined distance S was shorter than the radius R of the supplementary roller 26, the toner stuck to the reading face of the reading section 25; so that it was not possible to read the concentration accurately. When the predetermined distance S was made to be the same in length as the radius R of the supplementary roller 26, the toner did not stick to the reading face of the reading section 25 and flapping of the intermediate transfer belt 21 was able to be prevented as well; so that it was possible to read the concentration accurately. Further, when the predetermined distance S was longer than the radius R of the supplementary roller 26, the flapping of the intermediate transfer belt 21 was not able to be prevented; so that it was not possible to read the concentration accurately.

From the above, the predetermined distance S was determined to be the same in length as the radius R of the supplementary roller 26. This ensures that the toner falling from the surface of the intermediate transfer belt 21 does not stick to the reading face and that the flapping of the intermediate transfer belt 21 can be prevented as well; so that the reading section 25 can accurately read the concentrations of the toner images from the surface of the intermediate transfer belt 21.

Figure 4:
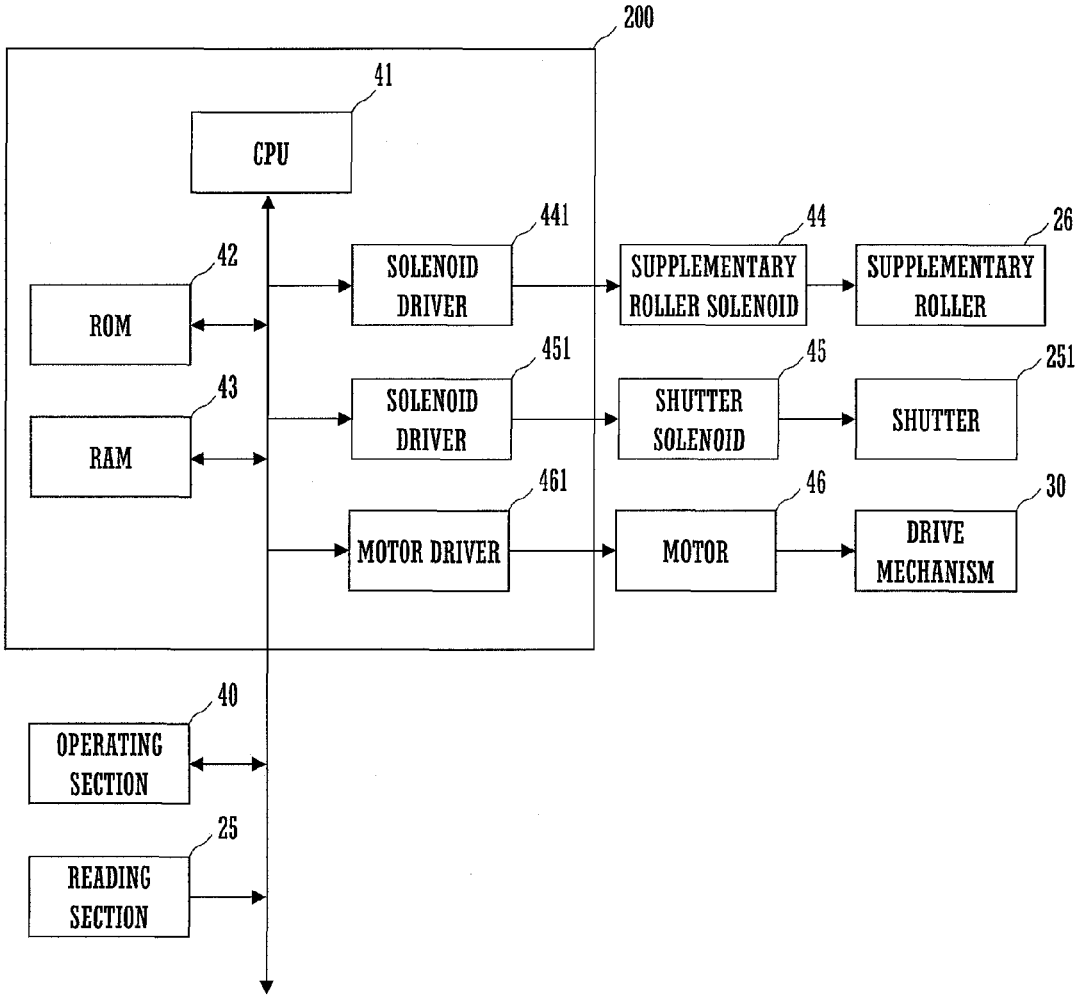
FIG. 4 is a block diagram of a control section of the image forming apparatus.

As shown in FIG. 4, the control section 200 is connected to an operating section 40, the reading section 25, the supplementary roller solenoid 44, the shutter solenoid 45 and a motor 46.

The operating section 40 accepts a start order of an image forming process, a start order of a concentration adjustment process and so forth. The concentration adjustment process detects concentrations of the toner images that are borne by the surface of the intermediate transfer belt 21, and changes imaging conditions depending on the detected concentrations. An imaging condition is, for example, quantity of a toner to supply to an electrostatic latent image, light quantity of an image light by the exposure unit 11, voltage value of a primary transfer voltage and so forth. Additionally, the concentration adjustment process is also performed at the time when the power to the image forming apparatus 100 is turned on, for every predetermined numbers of the image forming process, at the time when an error handling process is performed in an image forming process and so forth.

Solenoid drivers 441, 451 respectively turn on electricity to the supplementary roller solenoid 44 and the shutter solenoid selectively, based on switching data. A Motor driver 461 supplies the power to the motor 46 selectively, based on driving data. The motor 46 is connected to a drive mechanism 30. The drive mechanism 30, by causing the primary transfer rollers 24A through 24D to be displaced to the contacting positions or the separate positions when the power is supplied to the motor 46, moves the primary transfer rollers 24A through 24D to a color disposition which is an arrangement for color image forming, to a monochromatic disposition which is an arrangement for monochromatic image forming, and to a standby disposition which is an arrangement for non-image forming, sequentially. In the color disposition, the primary transfer rollers 24A through 24D are located at the contacting positions. In the monochromatic disposition, the primary transfer roller 24A is located at the contacting position, while the primary transfer rollers 24B through 24D are located at the separate positions. In the standby disposition, the primary transfer rollers 24A through 24D are located at the separate positions.

The control section 200 includes CPU41, ROM42, RAM43, the solenoid drivers 441, 451 and the motor driver 461. The CPU41 reads out various kinds of programs stored in the ROM42, and performs the various kinds of programs, using the RAM43 as a working area.

The CPU41 carries out the image forming process and the concentration adjustment process. When performing the image forming process or the concentration adjustment process, the CPU41 outputs the driving data to the motor driver 461 so that the power is supplied to the motor 46. Also, only when performing the concentration adjustment process, the CPU41 outputs the switch data to the solenoid drivers 441, 451 so that electricity is turned on to the supplementary roller solenoid 44 and to the shutter solenoid 45.

Figure 5:
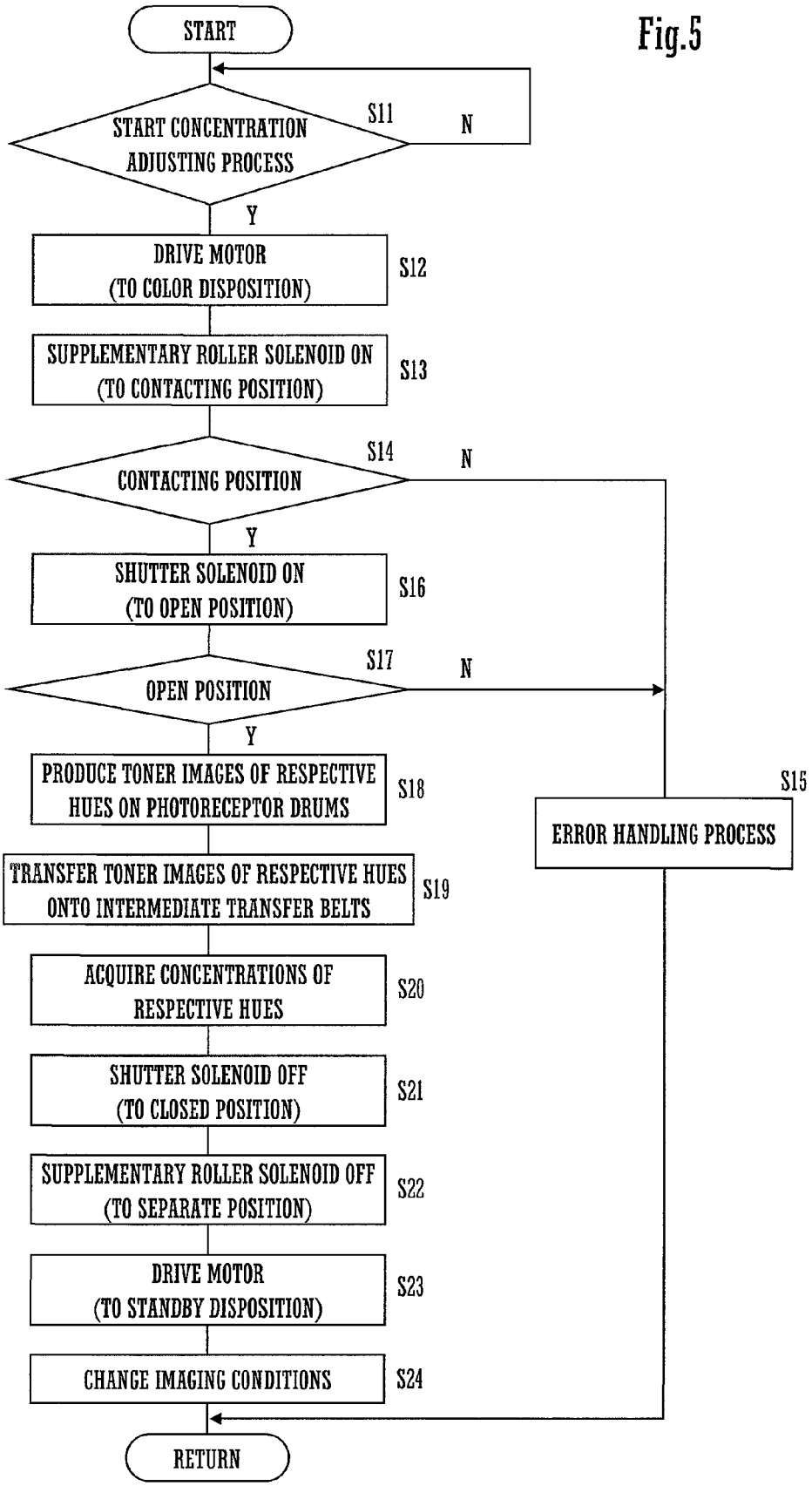
FIG. 5 is a flowchart showing a concentration adjustment process performed in the control section.

Below, the concentration adjustment process by the control section 200 is explained, referring to FIG. 5. As shown in FIG. 5, the control section 200 waits for a start timing of the concentration adjustment process to be met (S11). When the start timing of the concentration adjustment process is met, the control section 200 causes the primary transfer rollers 24A through 24D to move to the color disposition (S12) by driving the Motor 46. The control section 200 causes the supplementary roller 26 to move to the contacting position (S13) by turning on electricity to the supplementary roller solenoid 44. The control section 200 determines whether or not the position of the supplementary roller 26 is at the contacting position (S14) based on a result detected by a sensor (not shown) that detects whether or not the supplementary roller 26 is located at the contacting position. If the supplementary roller 26 is not located at the contacting position, the control section 200 carries out the error handling (S15), and then finish the process.

If the supplementary roller 26 is located at the contacting position, the control section 200 causes the shutter 251 to move to the open position (S16) by turning on electricity to the shutter solenoid 45. The control section 200 determines whether or not the position of the shutter 251 is at the open position (S17) based on a result detected by a sensor (not shown) that detects whether or not the shutter 251 is located at the open position. If the shutter 251 is not located at the open position, the control section 200 carries out the error handling (S15), and then finish the process.

If the shutter 251 is located at the open position, the control section 200 causes the processing section 1 to produce toner images of respective hues on the surfaces of the photoreceptor drums 12A through 12D (S18), and then, by applying the primary transfer voltages to the primary transfer rollers 24A through 24D, causes the toner images of the respective hues to transfer from the respective surfaces of the photoreceptor drums 12A through 12D onto the intermediate transfer belt 21 sequentially in such a manner as not to be superimposed one another (S19). The control section 200 acquires the concentrations of the toner images of the respective hues that have been read by the reading section 25 (S20). The control section 200 causes the shutter 251 to move to the closed position (S21) by turning off electricity to the shutter solenoid 45. The control section 200 causes the supplementary roller 26 to move to the separate position (S22) by turning off electricity to the supplementary roller solenoid 44. The control section 200 causes the primary transfer rollers 24A through 24D to move to the standby disposition (S23) by driving the Motor 46. The control section 200 changes the imaging conditions on the toner images of the whole hues (S24) based on the concentrations of the toner images of the respective hues that have been acquired from the reading section 25.

With the above-mentioned configuration, since the shutter 251 is located at the closed position except when the concentrations are read by the reading section 25, it is ensured that the toner falling from the intermediate transfer belt 21 does not stick to the reading face of the reading section 25. This ensures that the reading face of the reading section 25 is securely prevented from being stained by the falling toner.

Further, because the supplementary roller 26 is moved to the contacting position before the reading face of the reading section 25 is opened by the shutter 251 and then the supplementary roller 26 is moved to the separate position after the reading face of the reading section 25 is closed by the shutter 251, there is no chance that the toner that is caused to fall by an impulsive force generated when the supplementary roller 26 comes into contact with the intermediate transfer belt 21 sticks to the reading face of the reading section 25.

Additionally, although the concentration adjustment process is carried out following the movement to the color disposition in the above-mentioned embodiment, the concentration adjustment process may be carried out following the movement to the monochromatic disposition. In the monochromatic disposition, the imaging condition on the toner image of black can be adjusted.

Further, although the image forming apparatus 100 of the present invention has been exemplified by the one that transfers the toner images onto the paper sheet through the intermediate transfer belt 21, the invention does not apply only to such an embodiment, but the toner images may be transferred from the photoreceptor drums 12A through 12D directly onto a paper sheet passing between the photoreceptor drums 12A through 12D and a transfer belt.

Moreover, an endless belt of the present invention is not only the intermediate transfer belt 21, but may be a belt bearing the toner images. Further, the reading section 25 may be one that reads a meandering quantity of an endless belt when a meandering adjustment of the endless belt such as the intermediate transfer belt 21, a secondary transfer belt or the transfer belt is carried out. In this case, the endless belt is not limited to a belt bearing the toner images.

The intermediate transfer belt 21, due to its contact with the supplementary roller 26, is curved at a portion of contact with the supplementary roller 26. The toner on a surface of the curved intermediate transfer belt 21 can occasionally fall from a position below the supplementary roller 26 in vertical direction onto a downstream side of the supplementary roller 26 in a moving direction due to a gravitational force of the toner and an inertia force that is caused by the movement of the surface of the intermediate transfer belt 21. The toner that falls is very unlikely to stick to the reading face of the reading section 25 that is located on the upstream side of the supplementary roller in the horizontal direction. Because the toner is very unlikely to stick to the reading face, the reading section 25 can accurately read the toner images from the surface of the intermediate transfer belt 21.

In the case where the supplementary roller 26 is configured so as to be movable between the contacting position at which the supplementary roller 26 is in contact with the intermediate transfer belt 21 in such a manner that a gap between the reading face of the reading section 25 and the surface of the intermediate transfer belt 21 is kept constant and the separate position at which the supplementary roller 26 is away from the intermediate transfer belt 21, it is preferable that the intermediate transfer unit 2 further includes the supplementary roller solenoid 44 and the control section 200 which together constitute a moving mechanism that causes the supplementary roller 26 to be located at the contacting position only when the reading is carried out by the reading section 25.

The supplementary roller 26 moves from the separate position to the contacting position when the reading is carried out by the reading section 25. Due to an impulsive force generated when the supplementary roller 26 comes into contact with the intermediate transfer belt 21, the toner on the surface of the intermediate transfer belt 21 falls onto the downstream side of the reading section 25 in the horizontal direction. Since the toner falling from the surface of the intermediate transfer belt 21 is very unlikely to stick to the reading face, the reading section 25 can accurately read the toner images from the surface of the intermediate transfer belt 21.

It is preferable that the intermediate transfer unit 2 further includes the shutter 251 configured so as to be movable between the open position at which the shutter 251 opens the reading face and the closed position at which the shutter 251 closes the reading face, and the shutter solenoid 45 and the control section 200 which together constitute an open-close mechanism that causes the shutter 251 to be located at the open position only when the reading is carried out by the reading section 25.

Because the reading face of the reading section 25 is closed by the shutter 251 except when the reading is carried out by the reading section 25, there is no chance that the falling toner sticks to the reading face.

Further, it is preferable that the predetermined distance S is the same in length as the radius R of the supplementary roller 26.

Then, since the supplementary roller 26 comes into contact with the intermediate transfer belt 21 at a position away from the center M of the reading section 25 by a distance that is the same in length as the radius R of the supplementary roller 26 in the horizontal direction, the flapping of the intermediate transfer belt 21 facing the center M of the reading section 25 can be prevented. As a result, the reading section 25 can accurately read the toner images from the surface of the intermediate transfer belt 21. Also, because the toner falling from the surface of the intermediate transfer belt 21 is very unlikely to stick to the reading face, the reading section 25 can accurately read the toner images from the surface of the intermediate transfer belt 21.

The image forming apparatus 100 of the present invention includes the photoreceptor drums 12A through 12D which are photoreceptors, the intermediate transfer unit 2, and the primary transfer rollers 24A through 24D which are transfer members. The photoreceptor drums 12A through 12D bear the toner images on the surfaces. The primary transfer rollers 24A through 24D respectively transfer the toner images onto the intermediate transfer belt 21 from the surfaces of the photoreceptor drums 12A through 12D.

With the image forming apparatus 100, because the toner is very unlikely to stick to the reading face of the reading section 25, the toner images can be read accurately from the surface of the intermediate transfer belt 21; besides, it is made possible to carry out the concentration adjustment of the toner images and the meandering adjustment of the intermediate transfer belt 21; therefore, image quality failure can be prevented.

Figure 6:
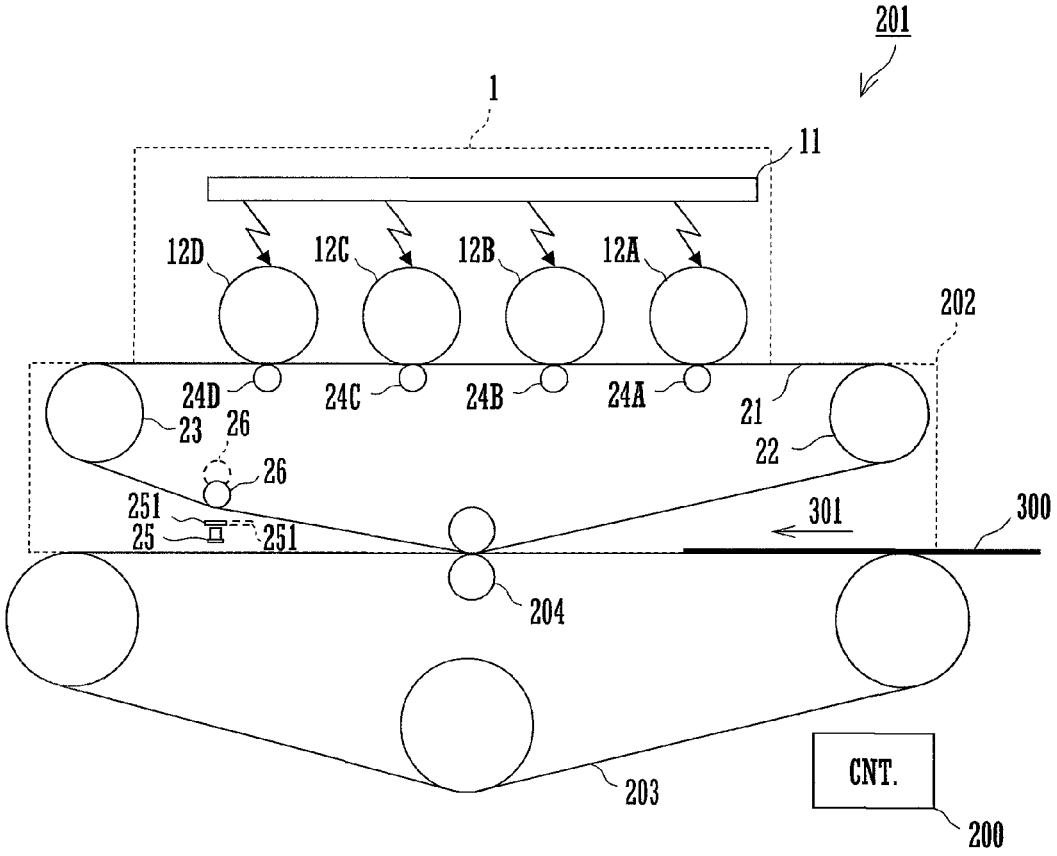
FIG. 6 is a schematic drawing of a part of an image forming apparatus according to another embodiment of the present invention.

Further, the relation in arrangement between the intermediate transfer unit 2 and the processing section 1 is not limited particularly; for example, although the intermediate transfer unit 2 is disposed on the upside of the processing section 1 in FIG. 1, it can be disposed on the downside of the processing section 1 as in an image forming apparatus 201 shown in FIG. 6. In FIG. 6, parts having the same configurations as the image forming apparatus 100 are given the same numbers as in FIG. 1, and explanations of such parts are omitted. In the image forming apparatus 201, the toner images are transferred by a transfer roller 204 from the intermediate transfer belt 21 onto a paper sheet conveyed on a transfer belt 203 toward a direction of an arrow 301.

The above explanations of the embodiments are nothing more than illustrative in any respect, nor should be thought of as restrictive. Scope of the present invention is indicated by claims rather than the above embodiments. Further, it is intended that all changes that are equivalent to a claim in the sense and realm of the doctrine of equivalence be included within the scope of the present invention.

What is claimed is:

1. A belt unit comprising:

an endless belt supported in such a manner that a surface thereof bearing a toner image can perform a circulating motion along a predetermined moving direction;

a reading section that is disposed below the endless belt in a vertical direction and reads the toner image from the surface of the endless belt;

a supplementary roller is configured so as to be movable between a contacting position at which the supplementary roller is in contact with a rear face of the endless belt in such a manner that a gap between a reading face of the reading section and the surface of the endless belt is kept constant and a separate position at which the supplementary roller is away from the rear face of the endless belt, the supplementary roller being located on a downstream side of the reading section in a horizontal direction by a predetermined distance; and a moving mechanism that causes the supplementary roller to be located at the contacting position only when reading is carried out by the reading section, wherein the predetermined distance is a distance from a center of the reading face to a point of contact at which the supplementary roller is in contact with the endless belt in the horizontal direction, wherein the predetermined distance is the same in length as a radial distance of the supplementary roller.

2. A belt unit comprising:

an endless belt supported in such a manner that a surface thereof bearing a toner image can perform a circulating motion along a predetermined moving direction;

a reading section that is disposed below the endless belt in a vertical direction and reads the toner image from the surface of the endless belt;

a supplementary roller configured so as to be movable between a contacting position at which the supplementary roller is in contact with a rear face of the endless belt in such a manner that a gap between a reading face of the reading section and the surface of the endless belt is kept constant and a separate position at which the supplementary roller is away from the rear face of the endless belt, the supplementary roller having a pivot center located on a downstream side from a center of the reading face in a horizontal direction by a distance that is greater than or equal to a radius of the supplementary roller; and a moving mechanism that causes the supplementary roller to be located at the contacting position only when reading is carried out by the reading section.

3. A belt unit comprising:

an endless belt supported in such a manner that a surface thereof bearing a toner image can perform a circulating motion along a predetermined moving direction;

a reading section that is disposed below the endless belt in a vertical direction and reads the toner image from the surface of the endless belt;

a supplementary roller configured so as to be movable between a contacting position at which the supplementary roller is in contact with a rear face of the endless belt in such a manner that a gap between a reading face of the reading section and the surface of the endless belt is kept constant and a separate position at which the supplementary roller is away from the endless belt, the supplementary roller having a pivot center located on a downstream side from a center of the reading face in a horizontal direction by a distance that is equal to a radius of the supplementary roller; and a moving mechanism that causes the supplementary roller to be located at the contacting position only when reading is carried out by the reading section.

* * * * *